US009004912B2

(12) United States Patent
Stoia et al.

(10) Patent No.: US 9,004,912 B2
(45) **Date of Patent: *Apr. 14, 2015**

(54) COMBUSTOR AND METHOD FOR SUPPLYING FUEL TO A COMBUSTOR

(75) Inventors: Lucas John Stoia, Taylors, SC (US); Patrick Benedict Melton, Horse Shoe, NC (US); James Harold Westmoreland, III, Greer, SC (US)

(73) Assignee: General Electric Company, Schenectady, NY (US)

( * ) Notice: Subject to any disclaimer, the term of this patent is extended or adjusted under 35 U.S.C. 154(b) by 813 days.

This patent is subject to a terminal disclaimer.

(21) Appl. No.: 13/294,261

(22) Filed: Nov. 11, 2011

(65) Prior Publication Data

US 2013/0122435 A1 May 16, 2013

(51) Int. Cl.
*F23N 1/02* (2006.01)
*F23R 3/28* (2006.01)

(52) U.S. Cl.
CPC ..... *F23R 3/286* (2013.01); *F23R 3/283* (2013.01)

(58) Field of Classification Search
CPC ..... F23R 3/28; F02C 7/22; F23Q 25/00
USPC ..... 431/264, 354, 12; 60/738, 749, 733, 60/737
See application file for complete search history.

(56) References Cited

U.S. PATENT DOCUMENTS 3,771,500 A 11/1973 Shakiba
4,104,873 A 8/1978 Coffinberry
4,412,414 A 11/1983 Novick et al.
5,104,310 A 4/1992 Saltin
5,205,120 A 4/1993 Obländer et al.
5,213,494 A 5/1993 Jeppesen
5,341,645 A 8/1994 Ansart et al.
5,439,532 A 8/1995 Fraas
5,592,819 A 1/1997 Ansart et al.
5,707,591 A 1/1998 Semedard et al.
6,098,407 A 8/2000 Korzendorfer et al.
6,123,542 A 9/2000 Joshi et al.
6,394,791 B2 5/2002 Smith et al.
6,438,961 B2 8/2002 Tuthill et al.
6,796,790 B2 9/2004 Venizelos et al.
6,983,600 B1 1/2006 Dinu et al.
7,003,958 B2 2/2006 Dinu et al.
7,007,478 B2 * 3/2006 Dinu ..... 60/737
7,631,499 B2 12/2009 Bland
7,752,850 B2 7/2010 Laster et al.
2004/0216463 A1 11/2004 Harris
2008/0016876 A1 1/2008 Colibaba-Evulet et al.
2008/0304958 A1 12/2008 Norris et al.
2009/0297996 A1 12/2009 Vatsky et al.

(Continued)

*Primary Examiner* — Gregory Huson
*Assistant Examiner* — Nikhil Mashruwala
(74) *Attorney, Agent, or Firm* — Dority & Manning, PA

(57) ABSTRACT

A combustor includes an end cap having an upstream surface axially separated from a downstream surface. A cap shield circumferentially surrounds the upstream and downstream surfaces, tubes extend from the upstream surface through the downstream, and a plenum is inside the end cap. A first baffle extends radially across the plenum toward the cap shield, and a plate extends radially inside the plenum between the first baffle and the upstream surface. A method for supplying fuel to a combustor includes flowing a working fluid through tubes, flowing a fuel into a plenum between upstream and downstream surfaces, radially distributing the fuel along a first baffle, and axially flowing the fuel across a plate that extends radially inside the plenum.

20 Claims, 3 Drawing Sheets

(56) References Cited

U.S. PATENT DOCUMENTS

| | | | | |
|---|---|---|---|---|
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1* | 1/2011 | Kraemer et al. | 60/772 |
| 2011/0072824 | A1 | 3/2011 | Zuo et al. | |
| 2011/0073684 | A1 | 3/2011 | Johnson et al. | |
| 2011/0076628 | A1* | 3/2011 | Miura et al. | 431/12 |
| 2011/0083439 | A1* | 4/2011 | Zuo et al. | 60/737 |
| 2011/0089266 | A1 | 4/2011 | Stoia et al. | |
| 2013/0074510 | A1* | 3/2013 | Berry | 60/772 |
| 2013/0122434 | A1* | 5/2013 | Stoia et al. | 431/12 |
| 2013/0122438 | A1* | 5/2013 | Stoia et al. | 431/144 |

* cited by examiner

COMBUSTOR AND METHOD FOR SUPPLYING FUEL TO A COMBUSTOR

FIELD OF THE INVENTION

The present invention generally involves a combustor and a method for supplying fuel to the combustor.

BACKGROUND OF THE INVENTION

Combustors are commonly used in industrial and power generation operations to ignite fuel to produce combustion gases having a high temperature and pressure. Various competing considerations influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of tubes may be radially arranged in an end cap to provide fluid communication for a working fluid to flow through the end cap and into a combustion chamber. A fuel may be supplied to a plenum inside the end cap to flow over the outside of the tubes to provide convective cooling to the tubes before flowing into the tubes to mix with the working fluid. The enhanced mixing between the fuel and working fluid in the tubes allows leaner combustion at higher operating temperatures while protecting against flashback or flame holding and controlling undesirable emissions. However, the convective cooling provided by the fuel before entering the tubes may result in uneven heating of the fuel. As a result, temperature and density variations in the fuel flowing through the tubes may produce thermal stress in the tubes and/or uneven fuel-working fluid ratios that adversely affect flame stability, combustor performance, and/or undesirable emissions. Therefore, an improved combustor and method for supplying fuel to the combustor that reduces thermal stress in the tubes and/or temperature and density variations in the fuel flowing through the tubes would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap configured to extend radially across at least a portion of the combustor, wherein the end cap includes an upstream surface axially separated from a downstream surface. A cap shield circumferentially surrounds at least a portion of the upstream and downstream surfaces, and a plurality of tubes extends from the upstream surface through the downstream surface to provide fluid communication through the end cap. A plenum is inside the end cap between the upstream and downstream surfaces. A first baffle extends radially across the plenum toward the cap shield, and a plate extends radially inside the plenum between the first baffle and the upstream surface.

Another embodiment of the present invention is a combustor that includes an upstream surface, a downstream surface axially separated from the upstream surface, and a cap shield that circumferentially surrounds at least a portion of the upstream and downstream surfaces. A plurality of tubes extends from the upstream surface through the downstream surface, and a plenum is between the upstream and downstream surfaces. A conduit extends inside the plenum to provide fluid communication to the plenum. A first baffle connected to the conduit extends radially across the plenum toward the cap shield, and a plate extends radially inside the plenum between the first baffle and the upstream surface.

Embodiments of the present invention may also include a method for supplying fuel to a combustor that includes flowing a working fluid through a plurality of tubes that extends axially from an upstream surface to a downstream surface. The method also includes flowing a fuel into a plenum between the upstream and downstream surfaces, radially distributing the fuel in a first direction along a first baffle between the upstream and downstream surfaces and around the plurality of tubes, and axially flowing the fuel across a plate that extends radially inside the plenum between the first baffle and the upstream surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
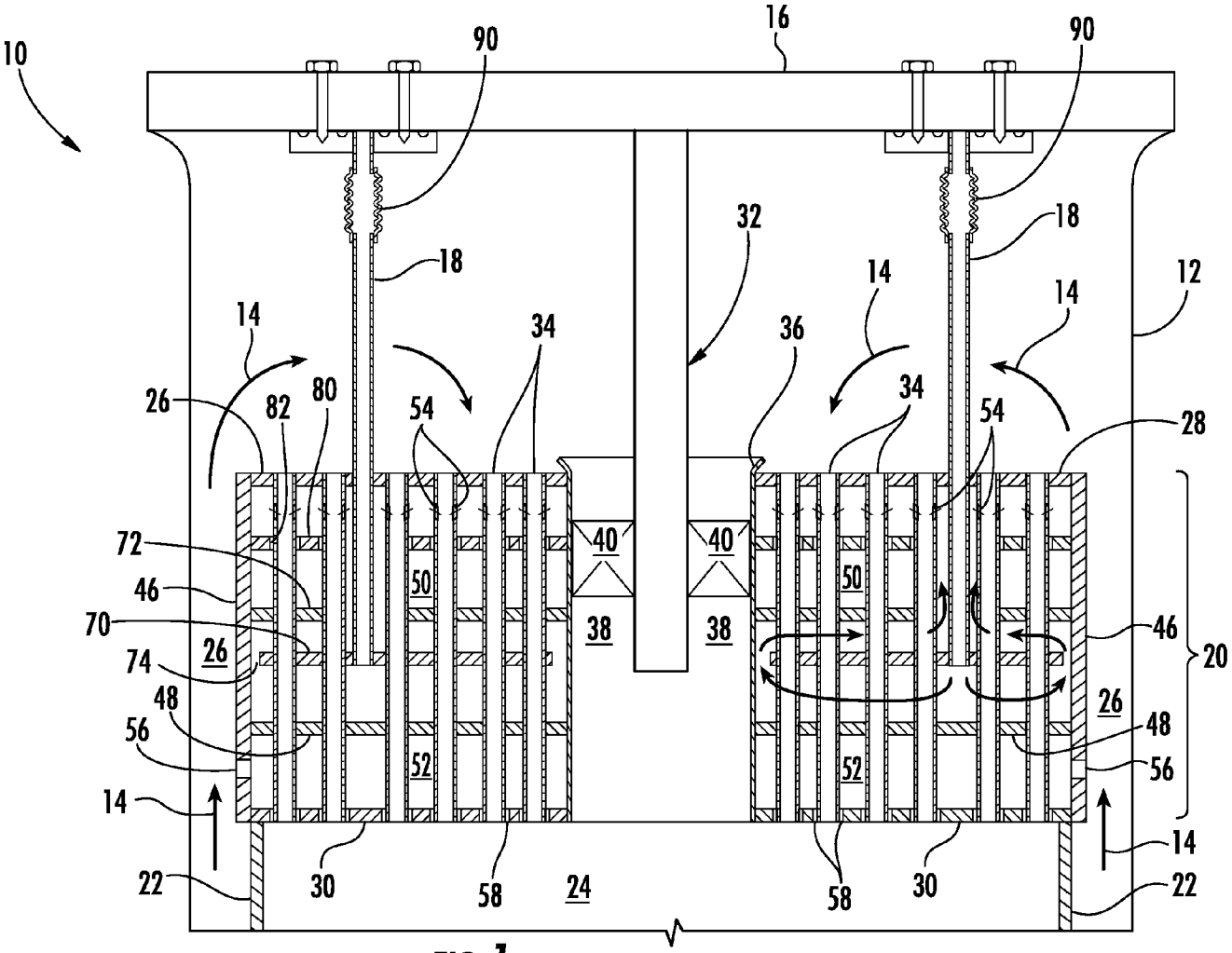
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for supplying fuel to the combustor. The combustor generally includes a casing that encloses a working fluid flowing though the combustor. A plurality of tubes radially arranged in an end cap enhances mixing between the working fluid and fuel prior to combustion. In particular embodiments, one or more baffles and/or plates may extend radially inside the end cap to distribute the fuel in the end cap, thereby allowing the fuel to evenly heat before the fuel flows into the tubes to mix with the working fluid. The improved heating of the fuel reduces the thermal stress across the tubes and/or the temperature and density variations in the fuel flowing through the tubes to enhance flame stability, combustor performance, and/or undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 2:
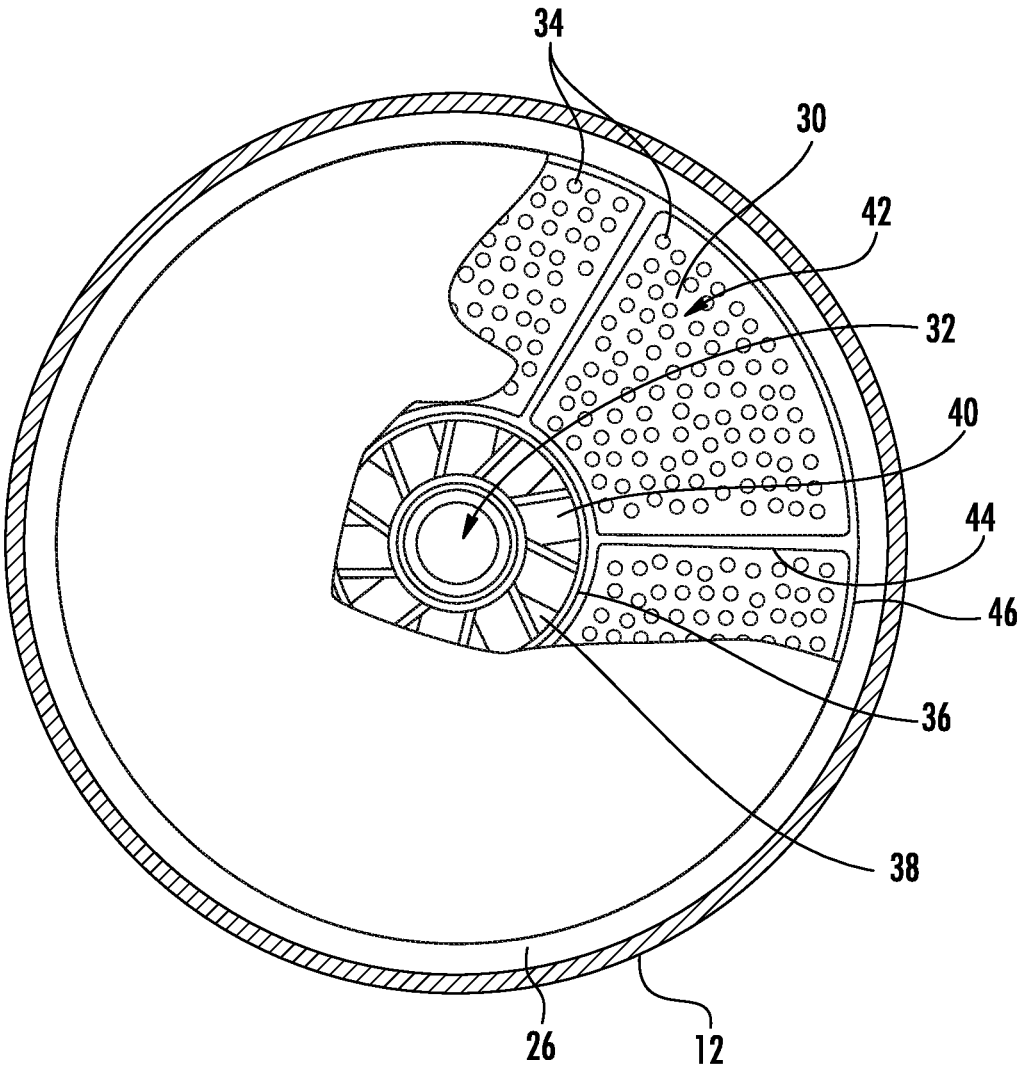
FIG. 2 is an upstream axial view of the combustor shown in FIG. 1 according to an embodiment of the present invention.

FIG. 1 provides a simplified cross-section view of an exemplary combustor 10 according to one embodiment of the present invention, and FIG. 2 provides an upstream axial view of the combustor 10 shown in FIG. 1. As shown, a casing 12 generally surrounds the combustor 10 to contain a working fluid 14 flowing to the combustor 10. The casing 12 may include an end cover 16 at one end to provide an interface for supplying fuel, diluent, and/or other additives to the combustor 10. Possible diluents may include, for example, water, steam, working fluid, air, fuel additives, various inert gases such as nitrogen, and/or various non-flammable gases such as carbon dioxide or combustion exhaust gases supplied to the combustor 10. One or more fluid conduits 18 may extend axially from the end cover 16 to an end cap 20 to provide fluid communication for the fuel, diluent, air, and/or other additives to the end cap 20. The end cap 20 is configured to extend radially across at least a portion of the combustor 10, and the end cap 20 and a liner 22 generally define a combustion chamber 24 downstream from the end cap 20. The casing 12 circumferentially surrounds the end cap 20 and/or the liner 22 to define an annular passage 26 that surrounds the end cap 20 and liner 22. In this manner, the working fluid 14 may flow through the annular passage 26 along the outside of the liner 22 to provide convective cooling to the liner 22. When the working fluid 14 reaches the end cover 16, the working fluid 14 may reverse direction to flow through the end cap 20 and into the combustion chamber 24.

As shown in FIGS. 1 and 2, the end cap 20 generally includes an upstream surface 28 axially separated from a downstream surface 30, and one or more nozzles 32 and/or tubes 34 may extend from the upstream surface 28 through the downstream surface 30 to provide fluid communication through the end cap 20. The particular shape, size, number, and arrangement of the nozzles 32 and tubes 34 may vary according to particular embodiments. For example, the nozzles 32 and tubes 34 are generally illustrated as having a cylindrical shape; however, alternate embodiments within the scope of the present invention may include nozzles and tubes having virtually any geometric cross-section.

The nozzle 32 may extend axially from the end cover 16 through the end cap 20. A shroud 36 may circumferentially surround the nozzle 32 to define an annular passage 38 around the nozzle 32 and provide fluid communication through the end cap 20. The working fluid 14 may thus flow through the annular passage 38 and into the combustion chamber 24. In addition, the nozzle 32 may supply fuel, diluent, and/or other additives to the annular passage 38 to mix with the working fluid 14 before entering the combustion chamber 24. One or more vanes 40 may extend radially between the nozzle 32 and the shroud 36 to impart swirl to the fluids flowing through the annular passage 38 to enhance mixing of the fluids before reaching the combustion chamber 24.

The tubes 34 may be radially arranged across the end cap 20 in one or more bundles 42 of various shapes and sizes, with each tube bundle 42 in fluid communication with one or more fluid conduits 18. For example, as shown in FIG. 2, one or more dividers 44 may extend axially between the upstream and downstream surfaces 28, 30 to separate or group the tubes 34 into pie-shaped tube bundles 42 radially arranged around the nozzle 32. One or more fluid conduits 18 may provide one or more fuels, diluents, and/or other additives to each tube bundle 42, and the type, fuel content, and reactivity of the fuel and/or diluent may vary for each fluid conduit 18 or tube bundle 42. In this manner, different types, flow rates, and/or additives may be supplied to one or more tube bundles 42 to allow staged fueling of the tubes 34 over a wide range of operating conditions.

A cap shield 46 may circumferentially surround at least a portion of the upstream and downstream surfaces 28, 30 to at least partially define one or more plenums inside the end cap 20 between the upstream and downstream surfaces 28, 30. For example, as shown most clearly in FIG. 1, a barrier 48 may extend radially inside the end cap 20 between the upstream and downstream surfaces 28, 30 to at least partially define a fuel plenum 50 and a diluent plenum 52 inside the end cap 20. Specifically, the upstream surface 28, cap shield 46, and barrier 48 may define the fuel plenum 50, and the downstream surface 30, cap shield 46, and barrier 48 may define the diluent plenum 52.

Figure 3:
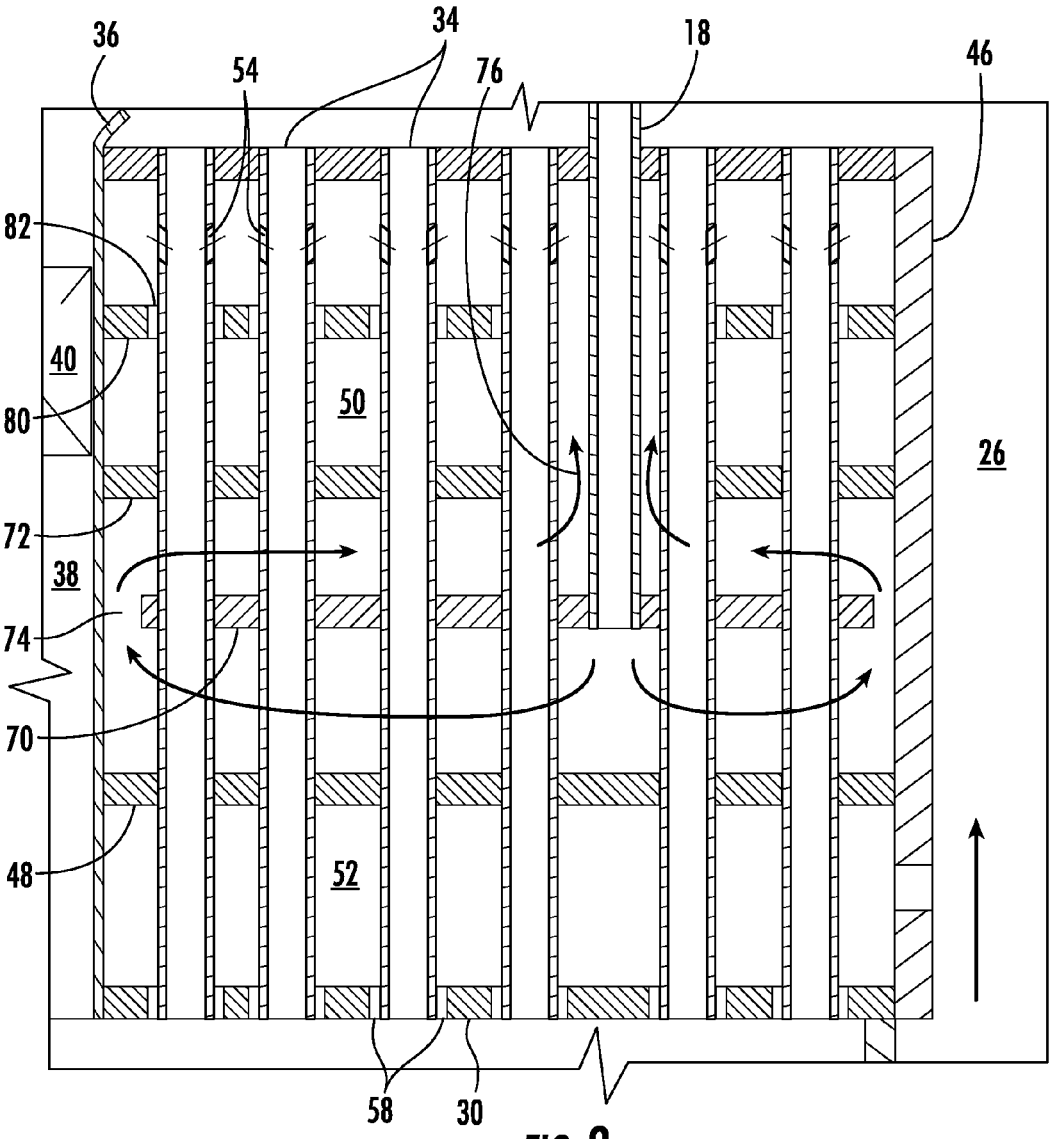
FIG. 3 is an enlarged cross-section view of a portion of the fuel plenum shown in FIG. 1.

FIG. 3 provides an enlarged cross-section view of a portion of the fuel plenum 50 shown in FIG. 1. As shown, the fuel plenum 50 may include one or more baffles that extend radially across the fuel plenum 50 to guide the fuel flow radially and axially in the fuel plenum 50. For example, a first baffle 70 may connect to the conduit 18 and extend radially outward across the fuel plenum 50 in all directions toward the cap shield 46. Conversely, a second baffle 72, axially separated from the first baffle 70, may connect to the cap shield 46 and extend radially inward across the fuel plenum 50 toward the conduit 18. A gap 74 between the first baffle 70 and the cap shield 46 allows the fuel to flow axially in the fuel plenum 50 across the first baffle 70, and a gap 76 between the second baffle 72 and the conduit 18 allows the fuel to flow axially in the fuel plenum 50 across the second baffle 72. One or ordinary skill in the art will readily appreciate that in alternate embodiments, the gaps 74, 76 may be positioned at alternate locations along the first and second baffles 70, 72 to allow the fuel to flow axially across the baffles 70, 72. In this manner, the fuel may flow from the conduit 18 into the fuel plenum 50, and the first baffle 70 may direct the fuel radially outward in the fuel plenum 50 toward the cap shield 46. As the fuel flows radially outward in the fuel plenum 50 around the tubes 34, the heat from the working fluid flowing through the tubes 34 is transferred to the fuel to heat the fuel and cool the tubes 34. When the fuel reaches the gap 74 between the first baffle 70 and the cap shield 46, the fuel flows axially through the gap 74 toward the second baffle 72. The second baffle 72 similarly directs the fuel radially inward in the fuel plenum 50 toward the conduit 18, allowing additional heat transfer between the tubes 34 and the fuel. When the fuel reaches the gap 76 between the second baffle 72 and the conduit 18, the fuel flows axially through the gap 76 toward the upstream surface 28. With each succeeding baffle inside the fuel plenum 50, the temperature of the fuel gradually increases until the fuel temperature of the fuel approaches or approximately equals the temperature of the working fluid. The fuel plenum 50 may further include a plate 80 that extends radially inside the fuel plenum 50 between the first baffle 70 and the upstream surface 28. The plate 80 may include a plurality of passages 82 through the plate 80 that provides fluid flow axially across the plate 80. In this manner, the passages 82 in the plate 80 may evenly distribute the heated fuel radially and/or axially inside the fuel plenum 50.

One or more of the tubes 34 may include a fuel port 54 that provides fluid communication from the fuel plenum 50 into the tubes 34. The fuel ports 54 may be angled radially, axially, and/or azimuthally to project and/or impart swirl to the fuel flowing through the fuel ports 54 and into the tubes 34. Similarly, the cap shield 46 may include one or more diluent ports 56 that provide fluid communication from the annular passage 26 through the cap shield 46 and into the diluent plenum 52. In this manner, fuel from the fluid conduit 18 may flow into the end cap 20 and along one or more baffles 70, 72 inside the fuel plenum 50 to provide convective cooling to the tubes 34 and heat the fuel. The heated fuel may then flow across the plate 80 and through the fuel ports 54 to mix with the working fluid flowing through the tubes 34. In addition, at least a portion of the compressed working fluid 14 may flow from the annular passage 26 through the cap shield 46 and into the diluent plenum 52 to provide convective cooling to the tubes 34. The working fluid 14 may then flow through one or more diluent passages 58 between the tubes 34 and the downstream surface 30 and into the combustion chamber 24.

The temperature of the fuel and working fluid flowing around and through the combustor 10 may vary considerably during operations, causing the casing 12, fluid conduits 18, and/or tubes 34 to expand or contract at different rates and by different amounts. As a result, a flexible coupling 90 may be included in one or more fluid conduits 18 between the end cover 16 and the end cap 20. The flexible coupling 90 may include one or more expansion joints or bellows that accommodate axial displacement by the casing 12, tubes 34, and/or conduits 18 caused by thermal expansion or contraction. One of ordinary skill in the art will readily appreciate that alternate locations and/or combinations of flexible couplings 90 are within the scope of various embodiments of the present invention, and the specific location or number of flexible couplings 90 is not a limitation of the present invention unless specifically recited in the claims.

The various embodiments shown and described with respect to FIGS. 1-3 may also provide a method for supplying fuel to the combustor 10. The method may include flowing the working fluid 14 through the tubes 34 and flowing the fuel into the fuel plenum 50 between the upstream and downstream surfaces 28, 30. The method may further include radially distributing the fuel in a first direction along the first baffle 70 between the upstream and downstream surfaces 28, 30 and around the tubes 34 and axially flowing the fuel across the plate 80 that extends radially inside the fuel plenum 50 between the first baffle 70 and the upstream surface 28. In particular embodiments, the method may further include radially distributing the fuel in a second direction along the second baffle 72, wherein the second direction is substantially opposite the first direction. The method may further include flowing the fuel through the fuel nozzle 32 adjacent to the tubes 34 and/or flowing at least a portion of the working fluid 14 around the tubes 34 in the diluent plenum 52.

The various embodiments shown and described with respect to FIGS. 1-3 provide one or more commercial and/or technical advantages over previous combustors. For example, the one or more baffles 70, 72 and/or plate 80 shown in FIGS. 1 and 3 enable the fuel to be more evenly heated by the working fluid 14 flowing through the tubes 34 before the fuel reaches the fuel ports 54 in the fuel plenum 50. The improved heating of the fuel reduces thermal stresses in the tubes and/or temperature and density variations in the fuel flowing through the tubes 34 to enhance flame stability, combustor performance, and/or undesirable emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

an end cap assembly configured to extend radially across at least a portion of the combustor, wherein the end cap includes an upstream surface axially separated from a downstream surface;

a cap shield that circumferentially surrounds at least a portion of the upstream and downstream surfaces;

a plurality of tubes that extends from the upstream surface through the downstream surface to provide fluid communication through the end cap;

a barrier that extends radially within the cap shield and that is axially spaced from the downstream surface;

a first baffle that extends radially within the cap shield and that is axially spaced from the barrier, wherein the first baffle and the barrier define a first plenum therebetween;

a radial gap defined between the first baffle and an inner surface of the cap shield; and a plate that extends radially inside the cap shield between the first baffle and the upstream surface, wherein the plate and the first baffle define a second plenum therebetween, wherein the radial gap provides for fluid communication between the first plenum and the second plenum.

2. The combustor as in claim 1, further comprising a second baffle connected to the cap shield, wherein the second baffle extends radially within the cap shield toward a conduit, wherein the conduit is in fluid communication with the first plenum.

3. The combustor as in claim 1, further comprising a conduit that extends inside the end cap assembly to provide fluid communication to the first plenum.

4. The combustor as in claim 1, further comprising a plurality of passages through the plate, wherein the plurality of passages provides fluid flow axially across the plate.

5. The combustor as in claim 1, further comprising one or more fuel ports through the plurality of tubes, wherein the one or more fuel ports provide fluid communication from the second plenum into the plurality of tubes.

6. The combustor as in claim 1, further comprising a third plenum defined between the first baffle and the downstream surface within the cap shield.

7. The combustor as in claim 6, further comprising one or more diluent ports through the cap shield, wherein the one or more diluent ports provide fluid communication through the cap shield and into the third plenum.

8. The combustor as in claim 6, further comprising a plurality of diluent passages through the downstream surface, wherein the plurality of diluent passages provides fluid communication from the third plenum through the downstream surface.

9. The combustor as in claim 1, further comprising a fuel nozzle that extends axially through the end cap.

10. A combustor, comprising:

an upstream surface;

a downstream surface axially separated from the upstream surface;

a cap shield that circumferentially surrounds at least a portion of the upstream and downstream surfaces;

a plurality of tubes that extends from the upstream surface through the downstream surface;

a conduit that extends through the upstream surface and into the cap shield;

a barrier that extends radially within the cap shield and that is axially spaced from the downstream surface;

a first baffle connected to the conduit, wherein the first baffle extends radially within the cap shield and is axially spaced from the barrier, wherein a radial gap is defined between the first baffle and an inner surface of the cap shield;

a first plenum defined between the first baffle and the barrier, wherein the first plenum is in fluid communication with the conduit;

a plate that extends radially inside the plenum between the first baffle and the upstream surface, wherein the plate and the first baffle define a second plenum therebetween, wherein the radial gap provides for fluid communication between the first plenum and the second plenum.

11. The combustor as in claim 10, further comprising a second baffle connected to the cap shield, wherein the second baffle extends radially within the cap shield from the inner surface of the cap shield toward the conduit within the second plenum.

12. The combustor as in claim 10, further comprising a plurality of passages through the plate, wherein the plurality of passages provides fluid flow axially across the plate.

13. The combustor as in claim 10, further comprising a third plenum defined between the downstream surface and the barrier.

14. The combustor as in claim 11, further comprising an axial passage between the second baffle and the conduit, wherein the axial passage provides fluid communication around the conduit.

15. The combustor as in claim 10, further comprising a divider that extends axially from the upstream surface to the downstream surface, wherein the divider separates the plurality of tubes into a plurality of tube bundles.

16. The combustor as in claim 10, further comprising a fuel nozzle that extends axially through the end cap.

17. A method for supplying fuel to a combustor, comprising:

flowing a working fluid through a plurality of tubes that extends axially from an upstream surface through a downstream surface of an end assembly;

flowing a fuel into a first plenum defined between a barrier and a first baffle, wherein the barrier and the first baffle extends radially within a cap shield of the end cap assembly and are each axially spaced from the upstream and downstream surfaces, wherein a radial gap is defined between the first baffle and an inner surface of the cap shield;

radially distributing the fuel in a first direction along the first baffle and around the plurality of tubes;

exhausting the fuel out of the first plenum via the radial gap; and axially flowing the fuel across a plate that extends radially inside the cap shield between the first baffle and the upstream surface.

18. The method as in claim 17, further comprising radially distributing the fuel in a second direction along a second baffle between the first baffle and the plate, wherein the second direction is substantially opposite the first direction.

19. The method as in claim 17, further comprising flowing fuel through a fuel nozzle adjacent to the plurality of tubes.

20. The method as in claim 17, further comprising flowing at least a portion of the working fluid around the plurality of tubes.

* * * * *

UNITED STATES PATENT AND TRADEMARK OFFICE

CERTIFICATE OF CORRECTION

PATENT NO. : 9,004,912 B2
APPLICATION NO. : 13/294261
DATED : April 14, 2015
INVENTOR(S) : Stoia et al.

It is certified that error appears in the above-identified patent and that said Letters Patent is hereby corrected as shown below:

In the claims

In Column 8, Line 20, in Claim 17, delete "end assembly;" and insert -- end cap assembly; --, therefor.

Signed and Sealed this
Twentieth Day of October, 2015

Michelle K. Lee

Michelle K. Lee
*Director of the United States Patent and Trademark Office*